United States Patent [19]

Stewart

[11] Patent Number: 4,680,949

[45] Date of Patent: Jul. 21, 1987

[54] LOCKING DEVICE FOR ARTICLES SUCH AS SAILBOARDS

[76] Inventor: Leo J. Stewart, 123 Pine Street, Hudson, Quebec, Canada

[21] Appl. No.: 854,841

[22] Filed: Apr. 22, 1986

[30] Foreign Application Priority Data

Feb. 24, 1986 [CA] Canada ..... 502520

[51] Int. Cl.[4] ..... E05B 73/00

[52] U.S. Cl. ..... 70/14; 70/58

[58] Field of Search ..... 70/14, 18, 19, 57, 58, 70/95, 99–100; 114/127, 140

[56] References Cited

U.S. PATENT DOCUMENTS

| | | |
|---|---|---|
| 3,091,011 | 5/1963 | Campbell . |
| 3,101,695 | 8/1963 | Honeyman, Jr. . |
| 3,714,803 | 2/1973 | Chenenko . |
| 3,727,934 | 4/1973 | Averbook et al. . |
| 3,754,420 | 8/1973 | Oellerich . |
| 3,959,995 | 6/1976 | Fletcher . |
| 4,340,376 | 7/1982 | Williams . |
| 4,526,125 | 7/1985 | Bain, Jr. . |

FOREIGN PATENT DOCUMENTS

| | | | |
|---|---|---|---|
| 202444 | 8/1920 | Canada . | |
| 208739 | 2/1921 | Canada . | |
| 985522 | 3/1976 | Canada . | |
| 1017965 | 9/1977 | Canada . | |
| 1085107 | 7/1954 | France | 70/14 |

*Primary Examiner*—Robert L. Wolfe

*Attorney, Agent, or Firm*—Killworth, Gottman, Hagan & Schaeff

[57] ABSTRACT

The invention provides a locking device for the securing against unauthorized removal of an article of manufacture of the type having an elongated groove therein with a re-entrant channel in at least one side wall of a groove for receiving one or more locking pins therein. The groove will also have a widened section therein defining an entry/exitway leading to the re-entrant channel from the exterior of the article. The locking device according to the invention includes a pair of relatively movable rigid members with at least one of the members having a locking pin therein which is adapted to enter into the groove via the above-noted entry/exitway and to engage in the re-entrant channel within the groove a desired distance away from the entry/exitway so as to prevent unwanted removal from the groove. The other of the rigid members is adapted to be locked in a selected position with respect to the first-noted member such that said at least one member is securely retained within said groove.

26 Claims, 27 Drawing Figures

LOCKING DEVICE FOR ARTICLES SUCH AS SAILBOARDS

BACKGROUND OF THE INVENTION

This invention relates to a locking device to assist in the securement against unauthorized removal of articles which do not have a convenient hole or slot in them through which a securing device such as a steel cable can be passed and then padlocked to a secure structure. Although not so limited, the invention is particularly suitable for use in the securement of sailboards of the type having a mast track therein defining an elongated groove, such groove typically having a re-entrant channel in at least one side wall of the groove.

The prior art has provided various devices for securing articles which are not normally fitted with a loop, a ring or suitable aperture which would permit a cable to be secured thereto and then secured to an inmovable object. For example, one such arrangement is shown in U.S. Pat. No. 4,526,125 issued July 2, 1985 entitled "Security Lock For Kayaks And The Like". The structure described includes a pair of hoops each being sufficiently large as to slip over and fit snugly on opposing end portions of the kayak body. Cables are secured between the hoops thereby to prevent them from being moved outwardly while a further cable is used to secure at least one of the hoops to an immovable object. Various forms of locking arrangements for skis are also shown employing various forms of brackets, harness arrangements and lock members, reference being made to U.S. Pat. Nos. 3,091,011, 3,955,995, 3,754,420, 3,727,934 and 3,714,803. U.S. Pat. No. 434,076 issued July 20, 1982 and entitled "Surfboard Locking Device" incorporates a U-shaped padlock eye which attaches to the base of the surfboard fin by means of the retaining screw which retains the surfboard fin in the fin holder. A locking bracket is placed over and locked to the padlock eye with a padlock together with the ends of a flexible member which connects the surfboard to a fixed object. When locked in place, the locking bracket prevents unauthorized removal of the padlock eye from the surfboard by preventing access to the fin retaining screw and also preventing rotation of the padlock eye and the above-noted fin retaining screw.

Various articles of manufacture, particularly sailboards, have an elongated groove formed in the body of same, such groove having a re-entrant channel in the side wall of the groove. For example, many varieties of sailboard employ a mast track having the above-noted characteristics. Such mast track is readily accessable after the mast has been removed, such as before placing the sailboard on either a storage stand or an automobile roof rack. Most sailboards also employ a fin track, which track is accessible after the fin has been removed.

Surfboards also have a comparable form of slot or groove therein which is available and accessible for use after the fin has been removed.

Thus far, none of the locking devices available are compatible with the structural features noted above to provide for secure locking of sailboards, surfboards and the like.

SUMMARY OF THE INVENTION

It is accordingly a primary object of the present invention to provide an improved locking device for use with various articles of manufacture of the type of having an elongated groove therein, that is, a groove having a re-entrant channel in at least one side wall of the groove. The locking device described hereafter is specially adapted to fit into and to securely lock within the groove structure noted above.

It is a further object of the invention to provide a locking device which is particularly suitable, although not limited to, the securement of sailboards and similar articles such as surfboards.

Thus, the invention in one aspect provides a locking device for the securing against unauthorized removal of an article of manufacture of the type having an elongated groove therein with a re-entrant channel in at least one side wall of a groove for receiving one or more locking pins therein. The groove will also have a widened section therein defining an entry/exitway leading to the re-entrant channel from the exterior of the article. The locking device according to the invention includes a pair of relatively movable rigid members with at least one of the members having a locking pin therein which is adapted to enter into the groove via the above-noted entry/exitway and to engage in the re-entrant channel within the groove a desired distance away from the entry/exitway so as to prevent unwanted removal from the groove. The other of the rigid members is adapted to be locked in a selected position with respect to the first noted member such that said at least one member is securely retained within said groove.

Retaining means for co-operating with either the re-entrant channel or the entry/exitway may be provided to retain the locking pin at the desired distance away from the entry/exitway whereby the locking device is securely retained within the groove.

In one form of the invention the above-noted retaining means is adapted to co-operate with the entry/exitway to prevent movement of the rigid members lengthwise of the groove thereby retaining the locking pin or pins the desired distance away from the entry/exitway.

In one form of the invention the rigid members comprised plate-like elements pivotally secured together with one of the above-noted locking pins being provided in each member. The two members have a combined thickness such as to allow them to enter into the groove in the article to be secured.

At least one and preferably both the members have means therein, such as mating apertures, for co-operation with a padlock eye to allow the two members to be locked and fixed together in the selected position relative to one another.

In the preferred form of the invention the above-noted plate-like elements are planar and parallel to one another and are arranged to pivot relative to one another in a common plane in a scissors-like fashion.

The above-noted retaining means preferably comprises a retention pin which is adapted to enter into and engage in the entry/exitway when the members are disposed in the selected positions relative to one another.

In one version of the locking device, the retention pin forms part of the means for pivotally securing the rigid locking members together. In another version, there is provided a retention pin as well as a separate pivot pin spaced from the retention pin for pivotally securing the rigid locking together.

In one version of the lock, a single one of the members is adapted to enter into the groove and it is provided with a single locking pin thereon while the other member has the retaining means thereon. In another version, one of the locking members has a spaced apart pair of locking pins thereon while the other member has the retaining means thereon. The other member may be pivotally mounted relative to the first noted locking member.

The locking device may assume many different forms as will be readily apparent from the following description of preferred embodiments of the invention.

BRIEF DESCRIPTION OF THE VIEWS OF DRAWINGS

DETAILED DESCRIPTION OF PREFERRED EMBODIMENTS

Figure 1:
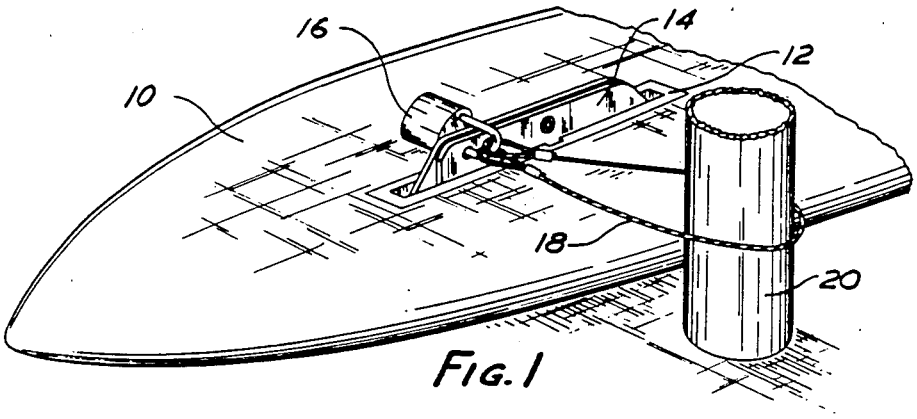
FIG. 1 is a perspective view of a portion of a sailboard having a locking device according to the invention secured within the mast track of the sailboard.
Figure 5:
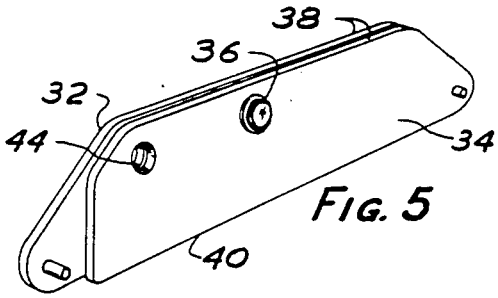
FIG. 5 is a perspective view of a first embodiment of the locking device according to the invention.
Figure 6:
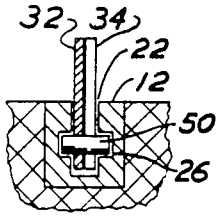
FIG. 6 is a cross-section view taken through the mast track and locking device when installed.
Figure 7:
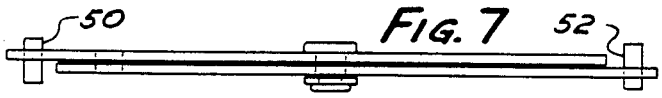
FIG. 7 is a plan view of the locking device.
Figure 8:
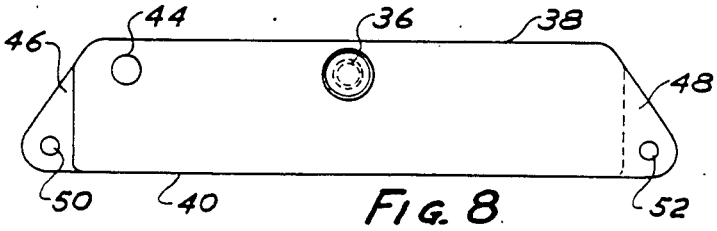
FIG. 8 is a side elevation view thereof.

With reference now to the drawings, FIG. 1 illustrates a portion of a sailboard 10 having a mast track 12 located in the upper surface of same. A locking device 14 in accordance with the invention is secured within mast track 12 and locked in place by means of a padlock 16, the eye of which padlock 16 is also attached to a steel cable 18, such cable passing around a fixed post 20 thereby to provide assurance against unauthorized removal of sailboard 10.

Figure 2:
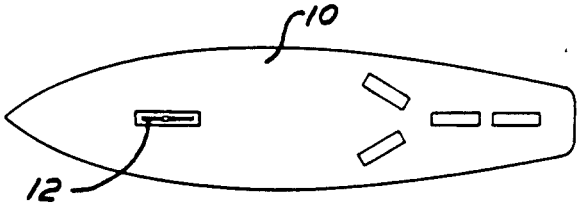
FIG. 2 is a somewhat diagramatic plan view of a sailboard.
Figure 3:
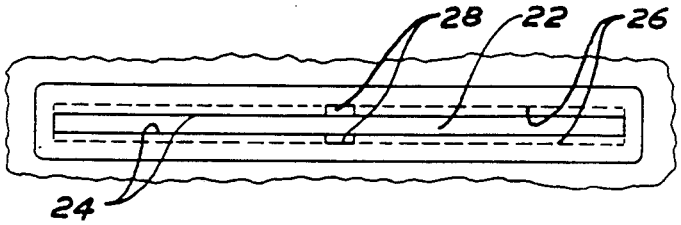
FIG. 3 is an enlarged plan view of the sailboard mast track.
Figure 4:
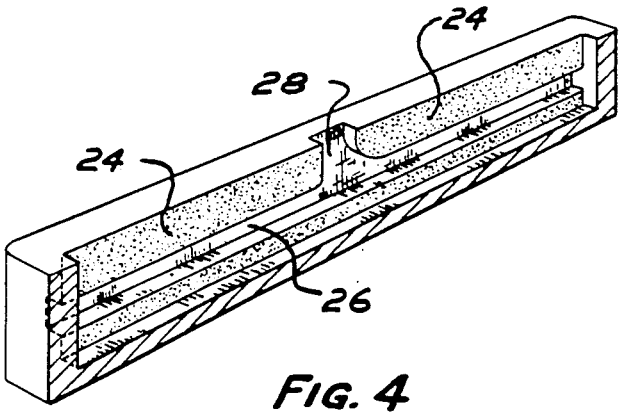
FIG. 4 is a section view in perspective through the mast track.

With reference to FIG. 2 the elongated mast track 12 is typically disposed in the forward portion of the sailboard, such mast track typically having the appearance illustrated in plan in FIG. 3. Mast track 12 includes an elongated groove 22, the opposing side walls 24 of the groove having re-entrant channels 26 formed therein. Groove 22 also has a widened section 28 therein defining an entry/exitway leading into the re-entrant channel 26 from the exterior of the mast track. This structure is clearly illustrated in the perspective section view of FIG. 4 which clearly illustrates the groove side walls 24, the entry/exitway 28, and the elongated re-entrant channel 26 formed in the groove side wall.

With particular reference now to FIGS. 5 through 8, it will be seen that a first embodiment of the invention comprises a pair of elongated planar plate-like members 32 and 34 pivotally connected together by way of a pivot pin 36. Members 32 and 34 are typically made from rigid steel plate. The upper and lower edges 38, 40 of the plate members 32 and 34 are straight and parallel to one another as illustrated. When the members 32 and 34 are moved into coincidence with one another as illustrated in FIGS. 5–8, such that their upper and lower edges 38 and 40 coincide with one another, a pair of apertures 44 in the respective members come into alignment with one another thereby to permit passage therethrough of the eye of a padlock, such as padlock 16 illustrated in FIG. 1.

Opposing ends of plate members 32 and 34 are sloped to provide projecting end portions as at 46 and 48 respectively and the outwardly projecting end portions are provided with locking pins 50 and 52 respectively, such locking pins extending transversely of their respectively associated plate members 32 and 34. The drawings also show locking pins 50, 52 as extending generally parallel to the pivot axis defined by pivot pin 36 which pivotally connects members 32 and 34 together. When installed in the mast track 12, the plate members 32 and 34 are disposed within the groove 22 described above with the locking pins 50, 52 projecting outwardly and engaging in the previously described re-entrant channel 26.

Figure 9:
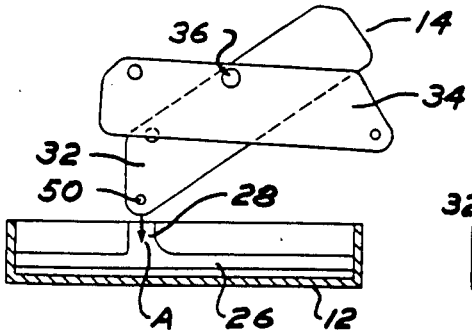
FIGS. 9 through 13 illustrate the various steps involved in the installation of the locking device of FIGS. 5–8 in the mast track.
Figure 10:
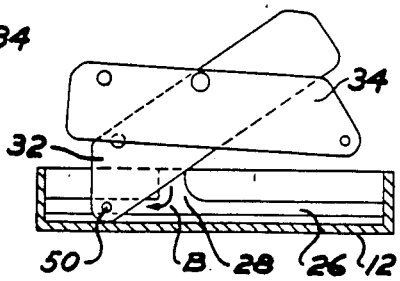
Figure 11:
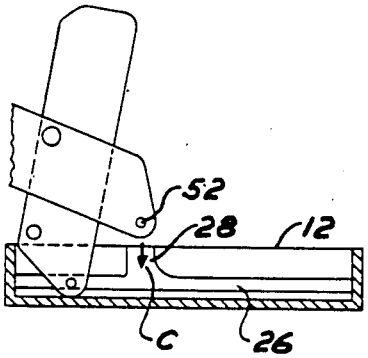
Figure 12:
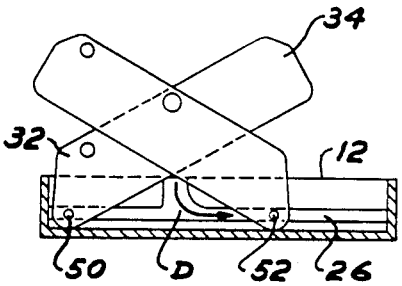
Figure 13:
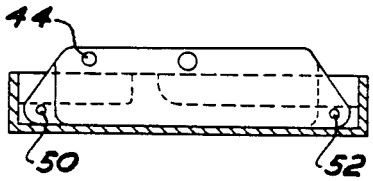

The procedure for installing the locking device 14 in mast track 12 is illustrated in FIGS. 9 through 13. With reference to FIG. 9, members 32 and 34 are pivoted relative to one another in scissors-like fashion about pivot pin 36 and the locking pin 50 is inserted into the entry/exitway 28 in the direction of arrow A. Following this and with reference to FIG. 10, the members 32 are then slid to the left in the direction of arrow B such that locking pin 50 moves away from entry/exitway 28 toward one end of the mast track 12. Then, with reference to FIG. 11, the members 32 and 34 are pivoted still further relative to one another and the locking pin 52 of the second members is inserted into entry/exitway 28 in the direction of arrow C. Members 32 and 34 are then rotated relative to one another such that locking pin 52 is made to move away from locking pin 50 along the re-entrant channel 26 of the mast track. This movement is illustrated by arrow D in FIG. 12. This procedure continues until the upper and lower edges 38 and 40 of the members come into coincidence with one another as illustrated in FIG. 13 at which point locking pins 50, 52 are disposed closely adjacent to the opposing ends of the mast track. In this position, the previously noted apertures 44 are in alignment with one another and the eye of a padlock 16 may be passed therethrough to secure the members in this particular position. Since the locking device 14 is almost as long as the mast track 12 itself, substantial end wise movement is not permitted and thus there is no change of the locking pins 50, 52 inadvertently escaping from the re-entrant channel 26 via entry/exitway 28. In other words, the opposing end portions 46, 48 form retaining means for preventing end-wise movement of the members 32, 34 along the groove thus preventing escape of the locking pins 50, 52 via the entry/exitway 28. It is also noted that the slopes on the opposing ends of plate members 32 and 34 are required to allow the locking device to be fully inserted into the mast track 12. Without these slopes, there would be interference between the ends of plate members 32 and 34 and the ends of the mast track before the locking device could be fully moved to its final locking position.

Figure 14:
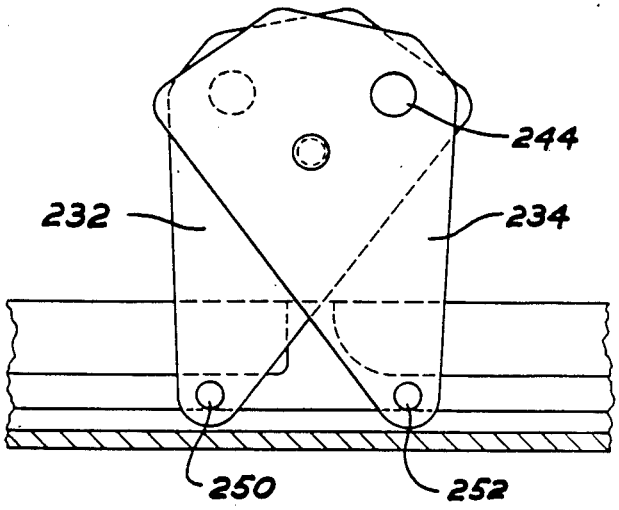
FIGS. 14 and 15 are side elevation views of the second embodiment of the invention just before and after installation of locking device.
Figure 15:
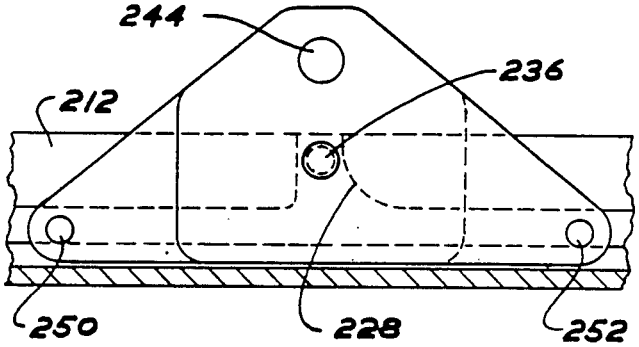

A second embodiment of the invention is illustrated in FIGS. 14 and 15. The numbering for parts similar to those described previously is employed except that each number has the prefix "2". It will be seen that the plate-like members 232 and 234 are somewhat triangular in outline, each being provided with padlock aperture 244 as described previously. This particular version is useful especially when the mast track 212 is considerably longer than the locking device when it is in the locking position illustrated in FIG. 15. In order to prevent end-wise movement of the locking device along the mast track 212, provision is made for the pivot pin 236 to double as a lock pin. In other words, the opposing ends of pivot pin 236 project outwardly of the sides of plate members 232 and 234 and the pivot pin itself is located such that in the locking position of FIG. 15 the pivot pin 236 engages in entry/exitway 228 and prevents the end-wise movement of the locking device.

Figure 16:
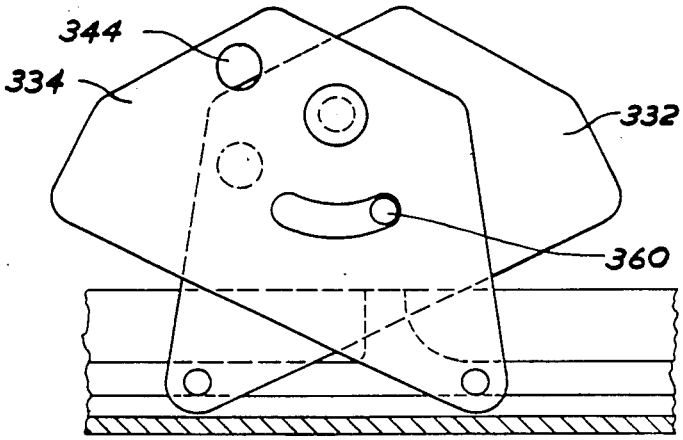
FIGS. 16 and 17 are views similar to FIGS. 14 and 15 but illustrating a third embodiment of the invention.
Figure 17:
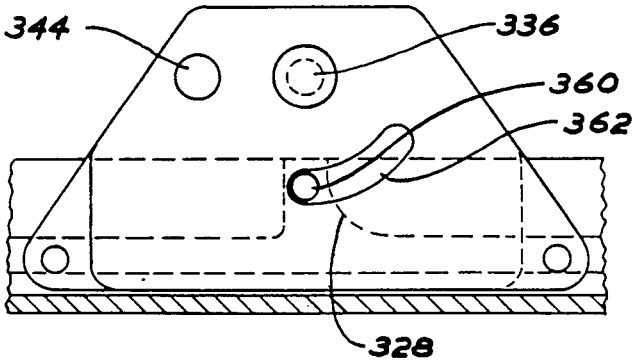

The third embodiment illustrated in FIGS. 16 and 17 is generally similar in principle to the second embodiment except that in addition to the pivot pin 336, a separate locking pin 360 has been added which engages in the entry/exitway 328 in the manner illustrated. An arcuate slot 362 in one of the plate members accommodates the lock pin 360 and permits a sufficient degree of pivotal movement to take place between the members 332 and 334.

Figure 18:
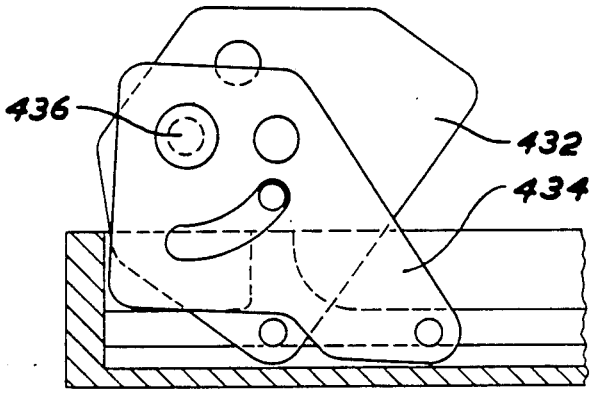
FIGS. 18 and 19 are views similar to FIGS. 16 and 17 but illustrating a fourth embodiment of the invention.
Figure 19:
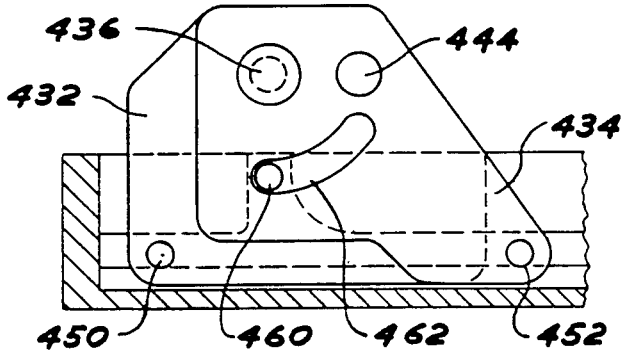

The embodiment of FIGS. 18 and 19 is essentially the same in principle as the third embodiment described previously except that it is shorter so that it will fit into the thruster tracks of a sailboard as well as the mast track and fin track. It will therefore be seen that this design is particularly versatile. As with the previously described embodiment a separate lock pin 460 is provided, with relative movement between the plate members 432 and 434 being provided by way of pivot pin 436 as well as arcuate slot 462 within which lock pin 460 moved during relative movement between the plate members.

Figure 20:
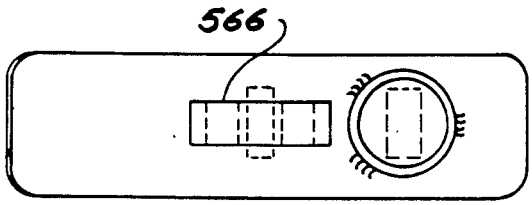
FIGS. 20 and 21 are plan and side elevation view of a fifth embodiment of the invention.
Figure 21:
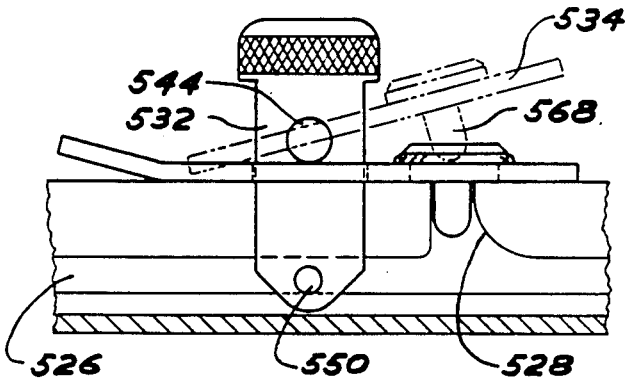

FIGS. 20 and 21 illustrate a fifth embodiment of the invention. In this case the plate member 532 is provided with only a single locking pin 550. This same plate member 532 is provided with a single padlock aperture 544. A second plate-like member 534 is not pivotally connected member to 532 as in the preceeding embodiments. Rather, it is provided with a rectangular slot 566 through which the member 532 projects at right angles. Member 534 is also provided with a retaining pin 568, which, when installed, projects downwardly into the entry/exitway 528. When the padlock is installed through the padlock aperture 544, the plate member 534 is held firmly downwardly in the full line position with the lock insert securely held in entry/exitway 528. This arrangement does not allow the member 532 to move along the re-entrant channel 526 and therefore the lock pin 550 cannot inadvertently escape from the re-entrant channel.

Figure 22:
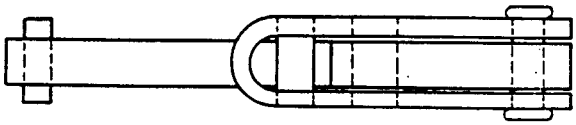
FIGS. 22 and 23 are plan and side elevation views of a sixth embodiment of the invention.
Figure 23:
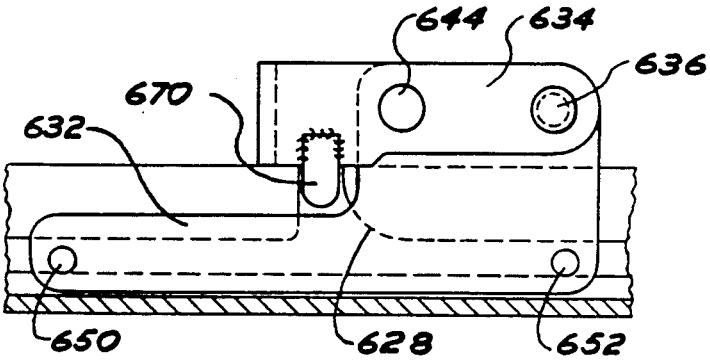

A sixth embodiment of the invention is illustrated in FIGS. 22 and 23. In this embodiment the first plate member 632 is provided with two lock pins 650 and 652. This embodiment would only be used in cases where the mast track is substantially longer than the locking device. During installation, the first lock pin 650 is inserted through the entry/exitway 628 and then slid along the re-entrant channel until the second lock pin 652 is just above entry/exitway 628, following which lock pin 652 is made to move downwardly and into the re-entrant channel with the entire locking device being shifted to the position illustrated in FIG. 23. The second member 634 is pivotally attached to member 632 via pivot pin 636 and member 634 carries a retaining member 670 adjacent to its free outer end, which retaining member 670 enters into the entry/exitway 628 while at the same time the padlock apertures 644 come into alignment with one another so that when a padlock is installed, the locking device is secured firmly in place.

Figure 24:
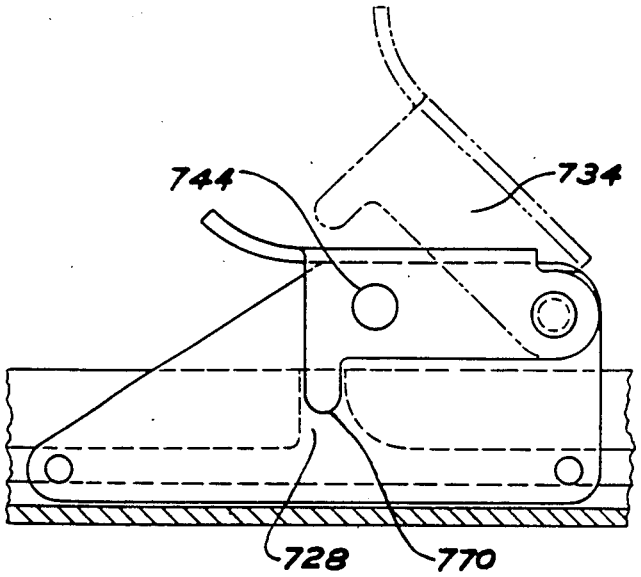
FIGS. 24 and 25 are side and elevation views of a seventh embodiment of the invention.
Figure 25:
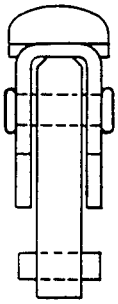

FIGS. 24 and 25 illustrate the seventh embodiment of the invention, which embodiment is quite similar to the sixth embodiment except that the second locking member 734 is of a modified design. Again, with the padlock apertures 744 in alignment and receiving the eye of a padlock, the retaining element 770 is firmly secured in the entry/exitway 728 thus preventing end-wise movement of the locking device as a whole.

Figure 26:
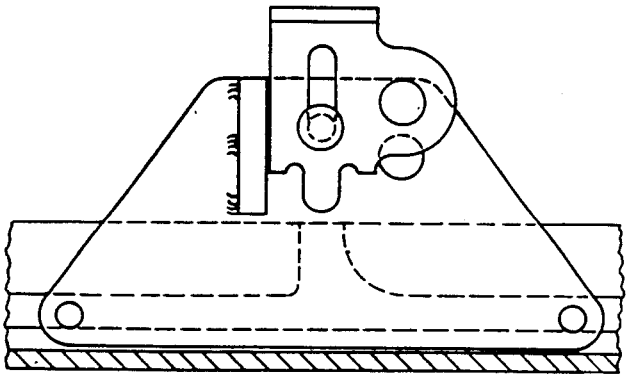
FIGS. 26 and 27 are side elevation views of an eighth embodiment of the invention.
Figure 27:
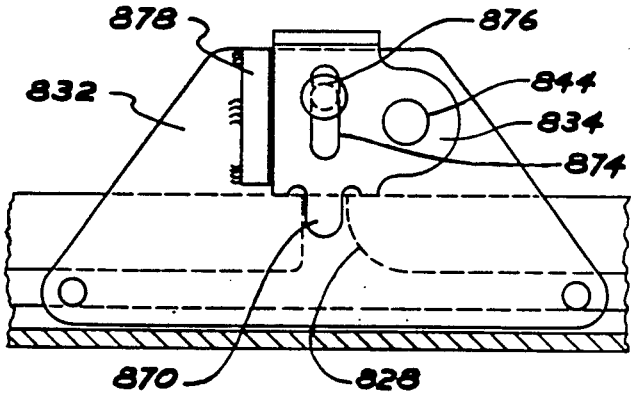

In the eighth embodiment illustrated in FIGS. 26 and 27, the member 834 is not pivotally connected to member 832 as in most of the preceeding embodiments but, rather, it is slidably movable relative thereto in a straight line path by virtue of slot 874 in member 834 and guide pin 876 mounted on member 832. A backing plate 878 engages an edge of member 834 to ensure relatively straight line motion of same. When the padlock apertures 844 of both members are in alignment, the retaining member 870 of member 834 projects downwardly into the entry/exitway 828 which leads into the re-entrant channel thus preventing end-wise movement of the locking device.

It will be appreciated from the above description of the many variations of the locking device described that they are all of a relatively simple yet very effective construction enabling the locking device to be manufactured at relatively low cost. For definitions of the invention reference is to be had to the appended claims.

I claim:

1. A locking device for the securing against unauthorized removal of an article of manufacture of the type having an elongated groove therein said groove having an elongated re-entrant channel in at least one elongated side wall of the groove for receiving one or more locking pins therein, said groove also having a widened section therein defining an entry/exitway leading into said elongated re-entrant channel from the exterior of said article, said locking device comprising a pair of relatively movable rigid members, at least one of said members having a locking pin therein and said at least one member and said locking pin therein being adapted to enter into said groove via said entry/exitway with said locking pin projecting outwardly from said at least one member in a direction relative to said at least one member as to enable said locking pin to project into and to engage in said re-entrant channel in said elongated side wall of said groove when said at least one member is disposed within said groove, and the other of said members adapted to be locked in a selected position with respect to said one member, such that said at least one member can be securely retained within said groove.

2. The locking device of claim 1 including retaining means for co-operating with said entry/exitway to prevent substantial movement of said at least one member along said groove to retain said locking pin within said re-entrant channel a desired distance away from said entry-exitway.

3. The locking device of claim 1 wherein the locking device is of sufficient length when said members are locked in the selected position with respect to each other as to prevent sufficient movement of said members lengthwise of the groove as to allow said locking pin to escape said re-entrant channel via the entry/exitway.

4. The locking device of claim 1 wherein said members comprise plate-like elements pivotally secured together in parallelism to each other for relative movement about a pivot axis, with one said locking pin on each member, each said locking pin projecting outwardly from its associated member in parallelism to said pivot axis, and the two members being of a combined thickness as to allow them to enter into said groove in the article.

5. The locking device of claim 2 wherein at least one of said members has means thereon for co-operation with a padlock eye or the like to allow the two members to be locked in the selected position relative to one another.

6. The locking device of claim 4 wherein at least one of said members has means thereon adapted to co-operate with a lock to fix the two members together in the selected position relative to one another.

7. The locking device of claim 5 wherein said members are plate-like elements which are planar and parallel to one another, each of which plate-like elements has a respective locking pin thereon, which elements are arranged to pivot relative to one another in a common plane in scissors-like fashion from relative positions wherein entry of said members and their locking pins via said entry/exitway is permitted to said selected locked position with respect to each other wherein both of said locking pins can project into and engage in said re-entrant channel at spaced apart locations.

8. The locking device of claim 7 wherein said retaining means adapted to co-operate with said entry/exitway comprises a retention means adapted to enter into and engage in said entry/exitway when said members are disposed in said selected position relative to one another.

9. The locking device of claim 7 wherein said retaining means adapted to co-operate with said entry/exitway comprises a retention pin, said retention pin forming part of a means for pivotally securing said plate-like elements together.

10. The locking device of claim 7 wherein said retaining means adapted to co-operate with said entry/exitway comprises a retention pin, and a pivot pin spaced from said retention pin for pivotally securing said plate-like elements together.

11. A locking device for the securing against unauthorized removal of an article of manufacture of the type having an elongated groove therein, such groove having a re-entrant channel in at least one side wall of the groove for receiving one or more locking pins therein, said groove also having a widened section therein defining an entry/exitway leading into said re-entrant channel from the exterior of said article, said locking device comprising a pair of relatively movable rigid members, at least one of said members having a locking pin therein and being adapted to enter into such groove via said entry/exitway and to engage in said re-entrant channel a distance away from said entry/exitway, and the other of said members adapted to be locked in a selected position with respect to said one member, such that said at least one member is securely retained within said groove and wherein only one of said members is adapted to enter into said groove.

12. The locking device of claim 11 wherein said one member which enters into said groove has a single locking pin thereon, while the other member has a retaining means thereon for co-operating with said entry/exitway to prevent substantial movement of said one member along said groove and hence retain said locking pin within said re-entrant channel a desired distance away from said entry/exitway.

13. The locking device of claim 11 wherein said one member which enters into said groove has a spaced apart pair of locking pins thereon, the other member having a retaining means thereon for co-operating with said entry/exitway to prevent substantial movement of said one member along said groove and hence retain said locking pin within said re-entrant channel a desired distance away from said entry/exitway.

14. The locking device of claim 1 wherein said locking device is specially adapted for the securement of a sailboard, the locking device being adapted to engage in a mast track groove and/or fin track or thruster track groove on the body of the sailboard.

15. The locking device of claim 12 wherein said one member is of plate-like configuration with said locking pin projecting transversely outwardly therefrom.

16. The locking device of claim 13 wherein said one member is of plate-like configuration and said locking pins projecting transversely outwardly therefrom.

17. A locking device for the securing against unauthorized removal of an article of manufacture of the type having an elongated groove therein, with an elongated re-entrant channel in at least one side wall of the groove for receiving one or more locking pins therein, said groove also having a widened section therein defining an entry/exitway leading into said re-entrant channel from the exterior of said article, said locking device comprising: a pair of plate-like members pivotally secured together for relative movement about a pivot axis, each of said members having a respective locking pin therein, said members and their locking pins being adapted to enter into said groove via said entry/exitway, said locking pins extending transversely of said plate-like members to enable said locking pins to enter into and to engage within said re-entrant channel in the side wall of the groove, and said members being adapted to be locked in a selected position with respect to one another with said locking pins in spaced apart relation to each other so that said plate-like members can be retained within said groove by their respective locking pins.

18. The locking device of claim 17 including retaining means for co-operating with said entry/exitway to prevent substantial movement of said plate-like members along said groove to retain said locking pins desired distances away from said entry-exitway to prevent escape of the locking pins from said re-entrant channel via said entry/exitway.

19. The locking device of claim 17 wherein the locking device is of sufficient length when said plate-like members are locked in the selected position with respect to each other as to prevent sufficient movement of said plate-like members lengthwise of the groove as to allow said locking pins to escape said re-entrant channel via the entry/exitway, opposing end portions of said plate-like members being sloped to avoid inteference with end portions of said elongated groove during installation of the locking device thereinto.

20. The locking device of claim 17 wherein at least one of said plate-like members has means thereon for co-operation with a padlock eye or the like to allow the two members to be locked in the selected position relative to one another.

21. The locking device of claim 17 wherein both of said plate-like members have apertures therein adapted to co-operate with a lock to fix the two plate-like members together in the selected position relative to one another.

22. The locking device of claim 17 wherein said plate-like members are generally planar and parallel to one another and are arranged to pivot relative to one another in a common plane in scissors-like fasion from relative positions wherein entry of said members and their locking pins via said entry/exitway is permitted to said selected position with respect to each other.

23. The locking device of claim 18 wherein said retaining means adapted to co-operate with said entry/exitway comprises a retention means adapted to enter into and engage in said entry/exitway when said plate-like members are disposed in said selected position relative to one another.

24. The locking device of claim 23 wherein said retaining means adapted to co-operate with said entry/exitway comprises a retention pin, said retention pin forming part of a means for pivotally securing said plate-like members together.

25. The locking device of claim 23 wherein said retaining means adapted to co-operate with said entry/exitway comprises a retention pin, and a pivot pin spaced from said retention pin for pivotally securing said plate-like members together.

26. The locking device of claim 17 wherein said locking device is specially adapted for the securement of a sailboard, the locking device being adapted to engage in a mast track groove or fin track or thruster track groove on the body of the sailboard.

* * * * *